United States Patent [19]

Furutu

[11] 4,187,970

[45] * Feb. 12, 1980

[54] APPARATUS FOR ATTACHING TAG PIN

[75] Inventor: Akira Furutu, Tokyo, Japan

[73] Assignee: Japan Bano'k Co., Ltd., Japan

[ * ] Notice: The portion of the term of this patent subsequent to May 23, 1995, has been disclaimed.

[21] Appl. No.: 904,297

[22] Filed: May 9, 1978

Related U.S. Application Data

[63] Continuation of Ser. No. 836,706, Sep. 26, 1977, abandoned, which is a continuation of Ser. No. 699,572, Jun. 24, 1976, Pat. No. 4,090,653.

[51] Int. Cl.[2] ..... B65C 5/06

[52] U.S. Cl. ..... 227/8; 227/67

[58] Field of Search ..... 227/67, 19, 8, 136

[56] References Cited

U.S. PATENT DOCUMENTS

| | | | |
|---|---|---|---|
| 3,652,004 | 3/1972 | Lozio | 227/67 |
| 3,815,798 | 6/1974 | Lavitch et al. | 227/67 X |
| 3,893,672 | 7/1975 | Bone | 227/67 |
| 3,924,788 | 12/1975 | Furutu | 227/67 |
| 3,948,128 | 4/1976 | Russell | 227/67 X |
| 4,090,653 | 5/1978 | Furutu | 227/67 |

*Primary Examiner*—Paul A. Bell

*Attorney, Agent, or Firm*—Armstrong, Nikaido, Marmelstein & Kubovcik

[57] ABSTRACT

This invention relates to a pistol-shaped, small-sized tag attacher, in which the transverse bar of a tag pin is caused to penetrate through an article such as cloth etc. to attach a tag thereto, said tag pin being moulded from thermoplastic resin into an H-shape comprising a transverse bar, a filament portion and a head portion.

The tag attacher is constructed such that the pin is directly driven by a lever to push the transverse bar of the tag pin. On the upper portion of the body of the device a feeding knob is provided and a ratchet wheel is driven by means of the knob to feed tag pins onto the axis of the grooved needle successively. Moreover, this tag attacher includes an adjusting element for adjusting the length of insertion of the grooved needle.

8 Claims, 12 Drawing Figures

APPARATUS FOR ATTACHING TAG PIN

This is a continuation, of application Ser. No. 836,706, filed Sept. 26, 1977 now abandoned which in turn, was a continuation of Ser. No. 699,572 filed 6/24/76, now U.S. Pat. No. 4,090,653.

BACK GROUND OF THE INVENTION

This invention relates to an apparatus for attaching a pin for tags to articles (mainly merchandise) by a simple operation.

A pin for tag attachment (hereinafter referred to tag pin) and an attaching apparatus therefor are, for example, known such as in U.S. Pat. No. 3,103,666. The tag pin in such as in that Patent is formed integrally from synthetic resin having molecular orientation properties similar to nylon etc. and it has a head portion, a transverse bar portion and a filament portion interconnecting the intermediate points of these portions and has an H-shape as a whole.

The apparatus according to the U.S. patent for attaching a tag comprises, as shown in FIGS. 6 and 7 thereof, a cutter, a feeding mechanism, and various levers and pins etc. for driving these members, and has considerably complicated construction.

Moreover, the apparatus for attaching a tag shown in the U.S. Patent is very difficult to operate, and when in the case the body and lever portion are gripped, a range of angle of the needle tip in which a needle attached at the forward end of the body can be directed to an article is only about 90° from the horizontal. Also, since the rod for pushing the transverse bar of the tag pin is constructed so as to be directly driven by the lever, there is a drawback in that its movement is not smooth.

Pistol type apparatuses for attaching tag pins have been proposed in U.S. Pat. No. 3,650,451 and Japanese Utility Model application publication No. 13056/71. These pistol type apparatuses are constructed such that the levers are arranged in a two-step fashion where one of the levers is movably biased by means of a spring so that the rod for pushing the transverse bar out of the needle tip is driven by this lever. This pistol type apparatus is easy to hold and sufficiently operative even if the needle is moved through 180° from top to bottom.

However, in order to obtain a superior function, the apparatus becomes inevitably large and requires many parts, with the result being increased production cost.

SUMMARY OF THE INVENTION

The first object of this invention is to provide a small sized, pistol type apparatus which permits easy handling of a tag pin and has a very simplified mechanism.

The second object of this invention is to provide an apparatus wherein handling is easy and the penetrating depth of a grooved needle can be varied.

The third object of this invention is to provide an apparatus which is small in size and easy to handle, thereby enabling the use in families in contrast with the prior art apparatus which is large and used only by makers and sellers of commodities such as clothes.

These objects are achieved according to this invention which is characterized in that a lever is supported for rocking movement, and a rod for pushing the transverse bar of tag pin is directly moved by means of the lever, and the tag pins are fed one by one into a position where they are pushed by the rod by means of a knob mounted at the upper portion of the body.

DETAILED DESCRIPTION OF PREFERRED EMBODIMENT

Figure 1:
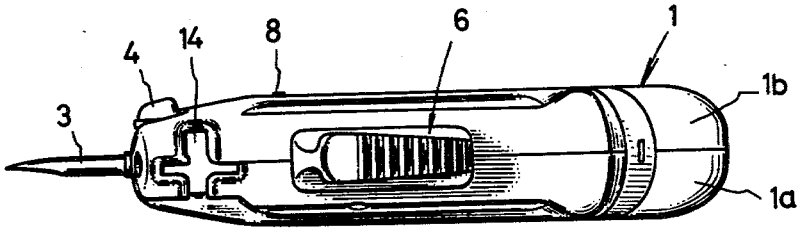
FIG. 1 is a plan view of an apparatus for attaching tag pin.
Figure 2:
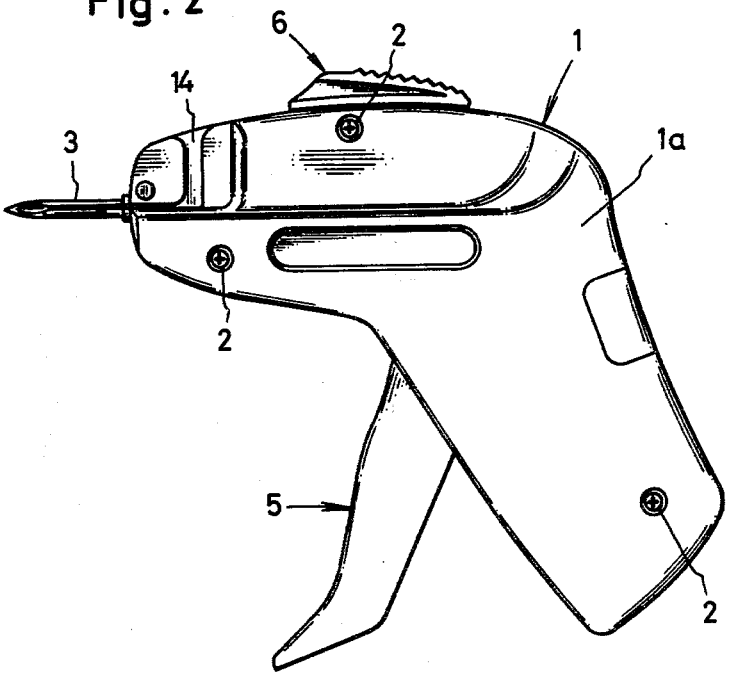
FIG. 2 is a right side elevational view of the same apparatus.
Figure 3:
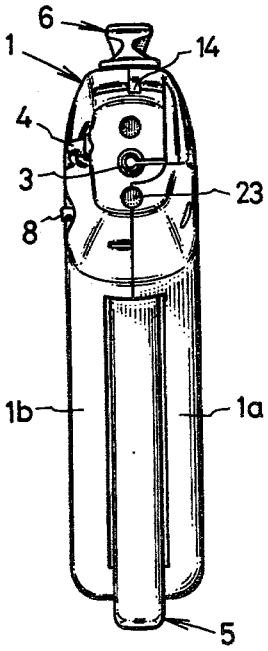
FIG. 3 is a front view of the same apparatus.

The invention will be described further by way of an embodiment of an apparatus for attaching a tag pin with reference to the accompanying drawings.

Referring to FIGS. 1 through 3, 1*a* is a right body portion and 1*b* is a left body, and these body portions are integrated by means of a plurality of screws 2. At the forward end of this body a grooved needle 3 is removably attached by means of a stopper 4. Element 5 is a lever, and a tag pin is fed into the grooved needle 3 by operation of this lever 5. A feeding knob 6 is provided at the upper portion of the body, by means of which tag pins are fed into the apparatus one by one.

Figure 4:
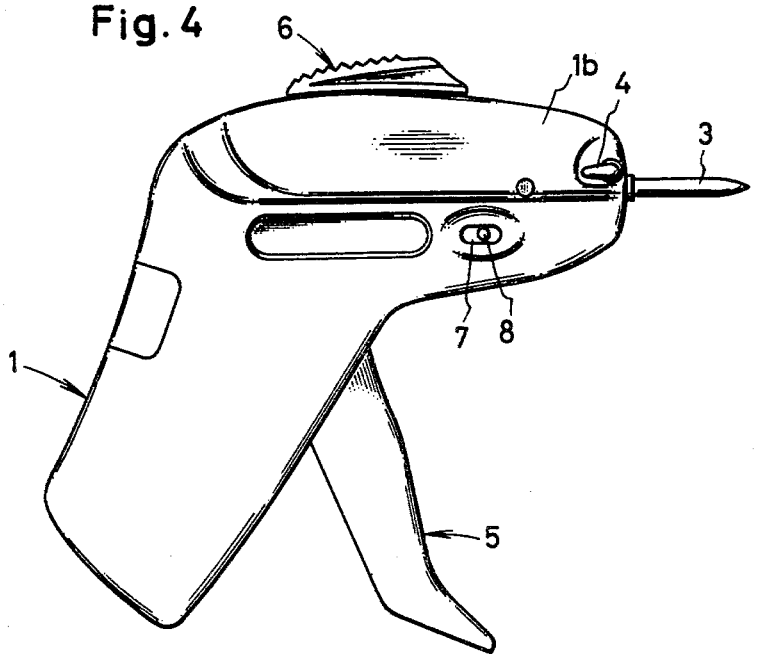
FIG. 4 is a partial left side elevational view of the same apparatus.

As shown in FIG. 4, a free lever 8 is provided to disengage a ratchet 17 projecting out of a hole 7 formed in the body portions 1*b* from a ratchet wheel 16.

Next, the interior construction of the apparatus for attaching tag pins will be explained with reference to FIG. 5.

At the grip portion of the pistol-shaped portions 1*a*, 1*b*, a lever 5 is pivotally supported by means of a pin 9, and biased in the direction of the arrow A by means of a spring 10. The body portions 1*a*, 1*b* are formed with a guide groove 11 in axial alignment with the axis of the grooved needle 3, and a piston 12 is moved in said groove. The piston 12 has projections 12*a* and 12*b* and a plate portion 12*c*, and has an H-shape when viewed from above, and said plate portion 12*c* is pinched by a bifurcated portion 5*a* of the lever. The forward end of the piston has attached thereto a pin 13, through which the transverse bar of the tag pin is forced into the grooved needle 3.

Figure 6:
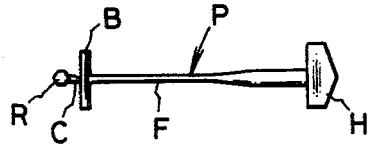
FIG. 6 is a front view of a group of tag pins.
Figure 7:
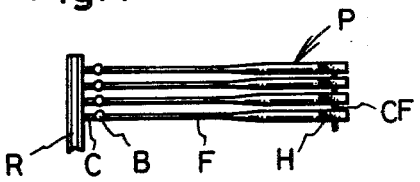
FIG. 7 is a side view of said tag pins.

FIG. 6 is a front view of a group of tag pins, and each tag pin P is composed of a transverse bar portion B, a filament portion F and a head portion H and connected to a connecting bar R via a connecting portion C. FIG. 7 is a side view of a group of tag pins, and tag pins P are arranged to the connecting bar R at given intervals, and the head portions H are interconnected by the connecting filaments CF so as to cause the head portions to align.

Figure 8:
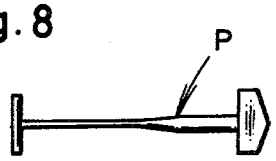
FIG. 8 is a front view of a tag pin.
Figure 9:
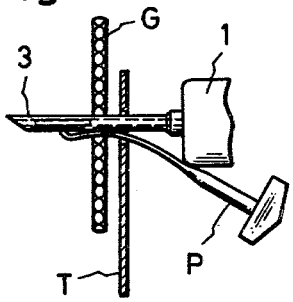
FIG. 9 is a view for explanation showing a condition for attachment of a tag to a cloth etc. by means of the tag pin.

FIG. 8 is a front view of a tag pin cut off at the connecting portion C, and in this condition this tag pin is pushed out of the grooved needle 3.

Where the tags are attached to clothes etc. by means of said tag pins, the operation is carried out as shown in FIG. 9. Namely, a tag T is supported by the grooved needle 3, and in this condition the grooved needle 3 penetrates through cloth G and then the lever 5 is withdrawn and thereby one of the tag pins is cut off from the group of the tag pins shown in FIGS. 6 and 7 and the transverse bar B is caused to pass through the grooved needle 3 thereby penetrating the cloth, and after the filament portion F has been restored to the state shown in FIG. 8 the tag T can be supported by the head portion H of the tag pin P and thus a tag can be attached to clothes or the like.

Again, referring to FIG. 5, numeral 14 is a slot, through which the connecting bar etc. is guided, said connecting bar interconnecting the tag pins. Numeral 15 is a cutter provided at the inlet portion of the grooved needle 3, and the connecting portion of the tag pin is pressed against this cutter so that the connecting portion is automatically cut off to separate one tag pin from a group of tag pins.

Numeral 16 is a ratchet wheel, and the connecting portion of the tag pin is pinched by a tooth of said wheel to feed the tag pin into position. Numeral 17 is a ratchet, at one end of which a pawl 17*a* is provided, and the tail portion 17*b* thereof serves as a spring, and this tail portion is locked by a projection on the body such that the pawl 17*a* is engaged with the ratchet wheel 16. On the side of the ratchet 17 facing the body 1*b* a free lever 8 is projected, and when said lever is pushed in the forward direction of the sheet face of the drawing, the pawl 17*a* is disengaged from the ratchet wheel 16 so that said wheel 16 can be freely rotated. On one side of the ratchet 17*a*, pin 17*c* is provided to support the ratchet on the body.

A feeding knob 6 has a feeding pawl 6*a* and a spring portion 6*b*, and the spring portion 6*b* is engaged with the projection 18 of the body 1*b* to permit movement in the direction of the arrow B to the feeding knob 6*b*. Numeral 4*a* is a shaft portion of a stopper 4, and by using the locking portion provided at a part of said shaft portion the grooved needle 3 is locked or released.

Next, the operation of the apparatus according to this invention will be described.

(A) The connecting bar R of the tag pin group shown in FIGS. 6 and 7 is inserted in the slot 14 to charge the tag pin group in the attachment apparatus.

Figure 5:
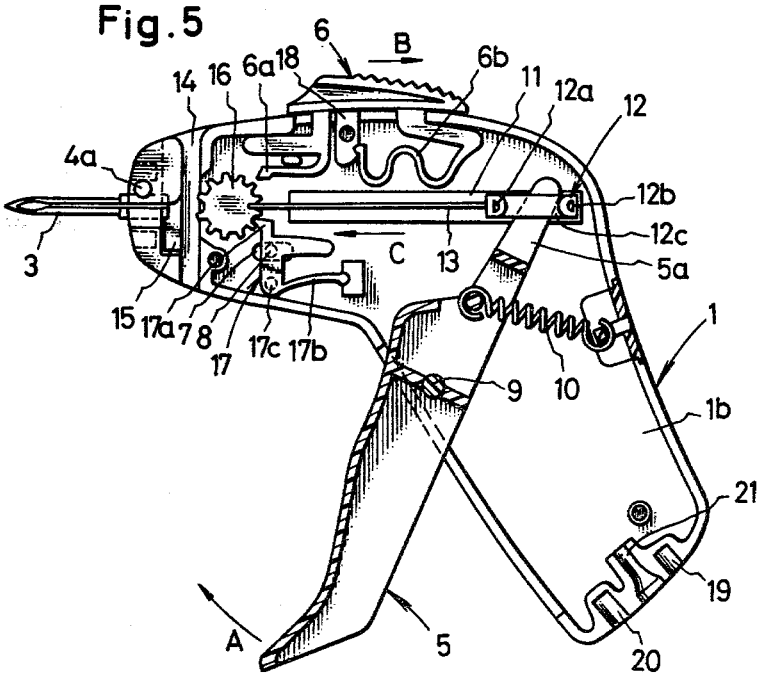
FIG. 5 is an elevational view showing the interior construction of the same apparatus, with the right hand body portion removed for clarity.

(B) The lever 5 is rotated in the direction of the arrow A in FIG. 5, and as a result the piston 12 and the pin 13 are moved in the direction of the arrow C, and thereby the transverse bar of the tag pin is pushed via the forward end of said pin 13, so that one of the tag pins is separated from the tag pin group and the separated tag pin is pushed out of the grooved needle. The grooved needle 3 has already penetrated an article such as cloth etc. as shown in FIG. 9 and also a tag T has been fitted onto the grooved needle 3 before said operation.

As described above, the transverse bar portion B and the filament portion F are pushed out of the forward end of the grooved needle 3 under a condition in which the needle 3 penetrates the article G and thereafter said transverse bar portion B and the filament portion F are restored into a crossed state at right angles. At the same time as this operation, or after this operation, the grooved needle 3 is withdrawn from the article G and thus the attachment of a tag to the article G is completed.

(C) Next, the knob 6 is pushed by the thumb in the direction opposite to the arrow B and the ratchet wheel 16 is engaged by the feeding pawl 6*a* and rotated a distance of one tooth portion of the ratchet wheel, with the result that the transverse bar portion B of a new tag pin is in direct contact with the end portion of the grooved needle 3. The driving force of the feeding knob 6 is thereafter released, and then this feeding knob 6 is moved in the direction of the arrow B by the action of the spring portion 6*b*, thereby causing the pawl 6*a* to separate from the tooth of the ratchet wheel 16.

(D) As with the above, the lever 5 and the knob 6 are successively operated, and the tag pins can penetrate the articles G one by one.

When the remaining tag pin group is removed from the attachment apparatus, the free lever 8 is driven to disengage the pawl 17*a* from the ratchet wheel 16 and thus makes the ratchet wheel 16 free and then the remaining tag pin group is allowed to be removed from attachment apparatus.

On the other hand, the tag pins differ in the length of the filament portion F according to the articles to which the tag pins are to be attached. For example, among the tag pins used at present the shortest one is of about 13 mm and longer ones are in the range of 50 mm to 100 mm. When a longer filament portion of a length of 25 mm or more is employed, the attachment operation of the tag pin is carried out easily, however when the length of the filament portion F is shorter than this size, the grooved needle (the part thereof projecting from the body) becomes longer than the filament portion F, so that when the attaching apparatus is operated, the head portion H is guided by the side face of the body or the grooved needle 3 and as a result a gap is produced between the grooved needle 3 and the filament portion F. The fact that the filament portion F is separated from the grooved needle 3 means that the hole formed in the article becomes larger than the hole of the grooved needle 3, and therefore when the article is, for example, made from a thin cloth, the texture of the cloth is displaced so that the value of merchandise will be lowered.

Accordingly, with the prior art attachment apparatus, a plurality of grooved needles of various lengths are provided, and the grooved needle is exchanged with another one according to the different length of the filament portion of the tag pin. This creates difficulty in that such an operation is troublesome as a matter of course and a plurality of grooved needles must be always kept.

With respect to this problem, in this invention the inserting depth of the grooved needle is adjusted by mounting an adjusting element at the root portion of the grooved needle.

Figure 10:
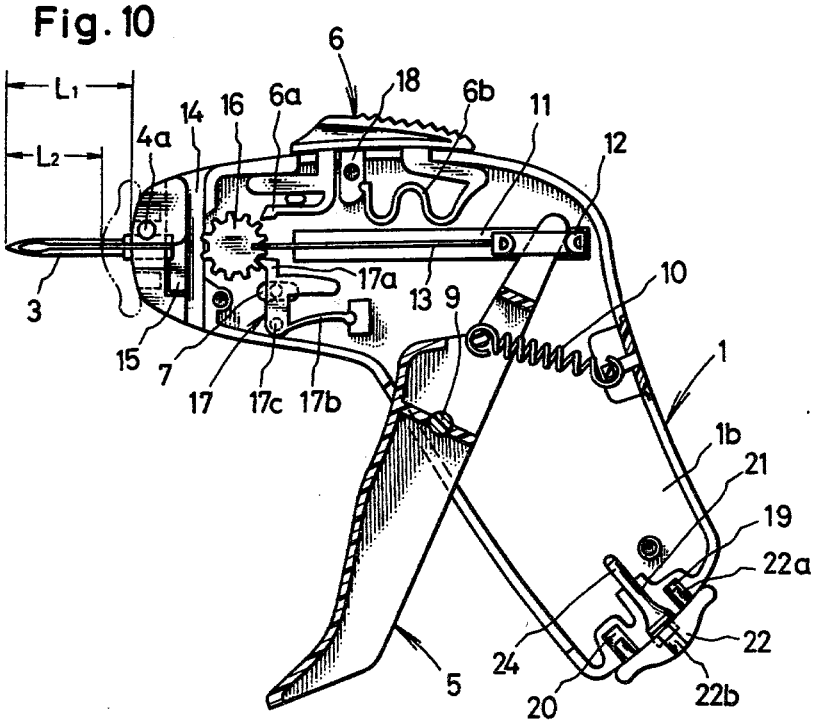
FIG. 10 is a view for explanation showing a condition for mounting an adjustment body and a needle cover onto the grip portion of the body.

As shown in FIG. 10, at the bottom portion of the grip portion of the body 1 holes 19, 20 and 21 are provided, and an adjusting element 22 is secured on said bottom by inserting a projection 22*a* thereof into the hole 19 and 20. Also, in the hole 21 a cover 24 of the grooved needle 3 is inserted.

The attachment apparatus according to this invention has a feature such that the adjusting element 22 is constructed so as to be removably attached to a portion of the grooved needle 3, and adjustment of the length of the grooved needle 3 is carried out as follows.

Figure 11:
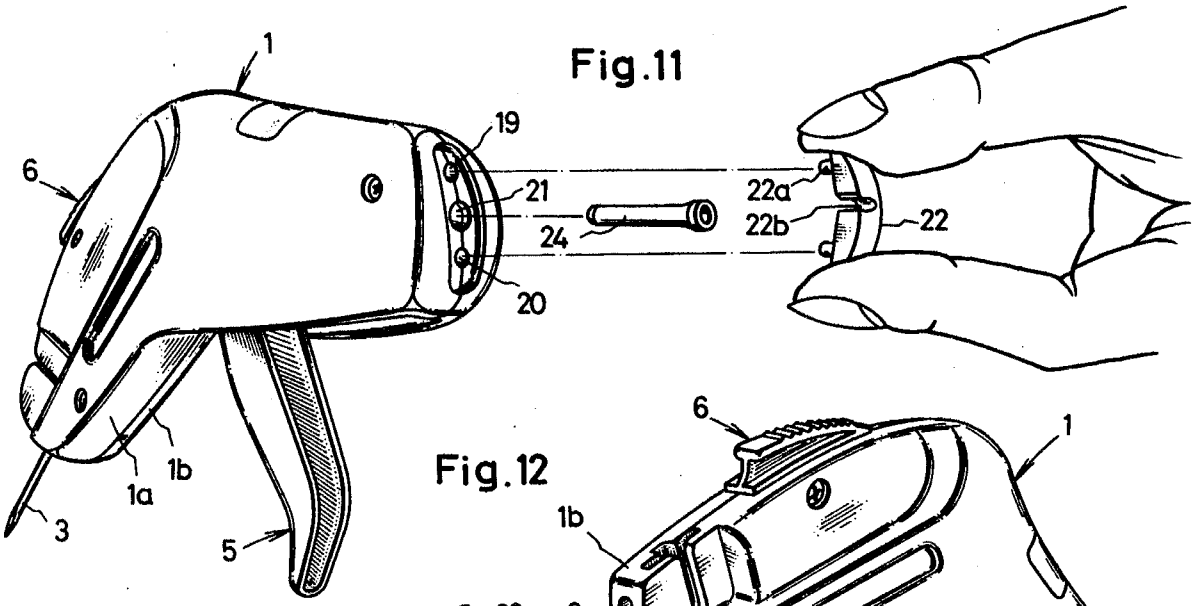
FIGS. 11 and 12 are a view for explanation showing a condition for mounting the adjustment element to the forward end of the body, namely to the root portion of a grooved needle.
Figure 12:
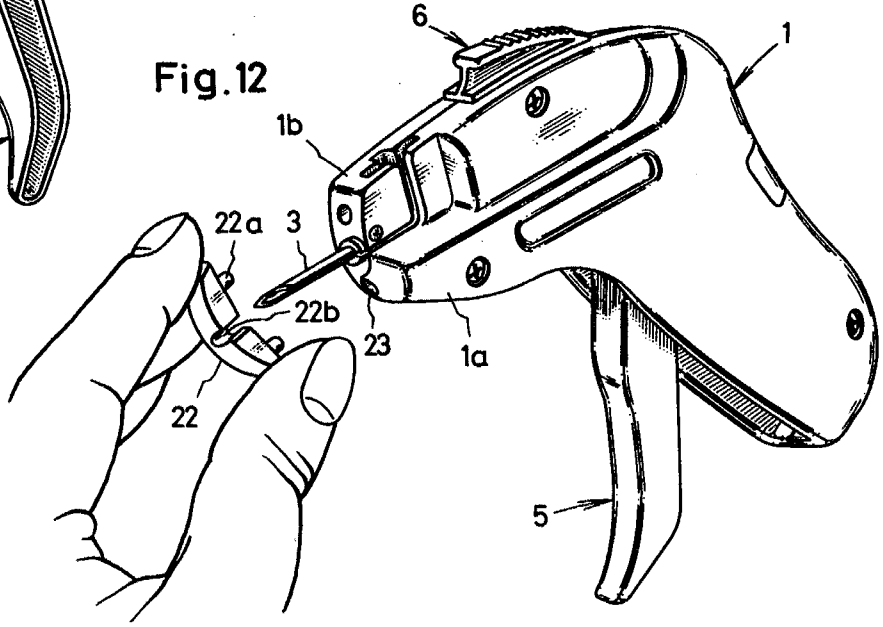

As shown in FIG. 11, the adjusting element 22 attached at the bottom of the grip portion of the body 1 is disengaged therefrom, and this adjusting element 22 is secured in position by inserting the projections 22*a* of the adjusting element 22 into the holes 23 formed in the forward end of the body 1. The adjusting element 22 has, for example, a shape as shown in FIG. 11, with a notch 22*b* formed on one side, so that the grooved needle 3 is located in the notch portion.

The shape of the adjusting element 22 is not limited in particular, and various modifications thereto may be permitted if it allows substantial adjustment of the length over which the grooved needle 3 can be inserted through the article.

FIG. 10 shows the adjusting element 22 by an imaginary line in a condition where it is attached to the forward end of the body 1, and usually the insertion length of the grooved needle 3 is $L_1$, but where this adjusting element 22 is attached in position, said insertion length is changed to $L_2$, and accordingly the condition of this situation is the same as that wherein a shorter grooved needle is used.

A tag attacher of this invention is constructed as described above, and therefore the following effects can be obtained:

(A) The lever 5 directly drives the pin 13 and the feeding knob 6 is provided on the upper portion of the body 1 so that the tag pins are successively fed by utilizing said knob, and accordingly the following additional effects are obtained.

(a) Since the mechanism is simplified, there is little trouble, and handling is easy so that it can be used in families and home environments.

(b) Since the mechanism is simplified, it can be produced in a small size and at a lower manufacturing cost.

(c) As shown in FIG. 5, all parts except for the spring 10 and the cutter 15 can be moulded from synthetic resin, and therefore production steps can be simplified. Moreover, since material free from generation of scale (particularly synthetic resin) can be used, various kinds of parts can be produced at a high efficiency.

(d) The thumb operates the feeding knob 6 and the fingers grip the body and operate the lever 5, so that operation of the device is carried out in two steps and the problem where the tag pins have been confused at the feeding mechanism portion inclusive of the ratchet wheel 16, is avoided.

(B) Since the lever 5 and the piston 12 are in direct engagement with each other, the movement of the lever 5 can be transmitted to the pin 13 directly. Owing to this, the movement of the pin 13 can be smooth and also the mechanism for operating the pin 13 can be simplified, and accordingly the attachment apparatus can be made in a small size and light in weight.

(C) The adjustment of insertion length of the grooved needle 3 is carried out by removably attaching the adjusting element 22 onto the root of the grooved needle 3, and accordingly the grooved needle can be utilized in at least two stages, whereby in the instance where the filament portion of the tag pin is short, the adjusting element 22 is attached at the forward end of the attachment apparatus so as to shorten the insertion length of the needle and thereby the transverse bar portion B of the tag pin is caused to project from the grooved needle 3 before the filament portion is deviated from the axis of the grooved needle so produce an elbow effect, and as a result a larger hole is never formed in the article.

In the case of a tag pin having a longer filament portion F, the adjusting element 22 is not used and the grooved needle 3 is used at a given length. Accordingly, according to this invention, it is unnecessary to exchange the grooved needle 3, and therefore it is unnecessary to provide, at all times, a plurality of lengths of grooved needles, so that efficiency of the operation is improved greatly.

In the embodiment of this invention described above, only one kind of adjusting element is provided. However, a plurality of adjusting elements of different heights can be used in a stack arrangement and thereby the adjustment of the insertion length of the grooved needle can be done in many ways.

Moreover, by moulding most parts of the attachment apparatus and the adjusting element from synthetic resin, productivity can be remarkably improved, and as a result of this, production cost can be lowered.

(D) In the tag attacher of this invention, the cap 24 of the grooved needle 3 and the adjusting element 22 which is fitted at the root portion of the grooved needle 3 and adapted to adjust the insertion length of said needle are removably attached to the body 1 and thus the cap 24 can always be provided in the body 1 and it can be removably attached to the grooved needle 3 when necessary, so that the security and good handling of the apparatus is assured.

Moreover, as shown in FIG. 11, when the cap 24 and the adjusting element 22 are provided at the bottom of the grip portion of the body, it seems as if these parts are not attached to the body, and consequently it provides a beautiful view and presents no obstacle with respect to handling of the apparatus.

What is claimed is:

1. An apparatus for attaching a tag-pin comprising:

a pistol-shaped body;

a lever supported on said body for rocking movement;

a rod driven by means of said lever;

a ratchet wheel mounted near a slot for inserting tag pins;

a ratchet for preventing the inverse rotation of the ratchet wheel and adaptable for disengagement therewith:

a feeding knob for driving said ratchet wheel;

a grooved needle provided at one end of said pistol-shaped body, said rod being located for movement on the axis of said needle;

a piston supporting said rod;

a trigger-like lever means directly driving said piston;

a free lever provided in relation to said ratchet for preventing inverse rotation of the ratchet wheel, said free lever being operated from the side of said body to produce disengagement of the ratchet from said ratchet wheel; and an adjusting means removably attached at the forward portion of said pistol-shaped body to adjust the length of insertion of said grooved needle into an article.

2. An apparatus according to claim 1, further comprising a cap removably attached at the forward portion of said body for protecting said grooved needle.

3. An apparatus according to claim 1, wherein said adjusting means is secured at the bottom of said grip portion of said body.

4. An apparatus according to claim 3, wherein said adjusting means comprises:

an adjusting body with a projection; and an opening provided at the bottom of said grip portion, the projection being inserted into the opening to secure said adjusting means.

5. An apparatus for attaching a tag pin comprising:

a pistol-shaped body;

a lever supported on said body for rocking movement;

a rod driven by means of said lever;

a ratchet wheel mounted near a slot for inserting tag pins;

a ratchet for preventing the inverse rotation of said ratchet wheel and adaptable for disengagement therewith;

a feeding knob having a feeding pawl element adapted for engagement with said ratchet wheel to drive said ratchet wheel;

a spring for return movement of said feeding pawl element;

a grooved needle provided at one end of said pistol-shaped body said rod being located for movement on the axis of said needle;

a piston supporting said rod;

a trigger-like lever means for directly driving said piston;

a free lever provided in relation to said ratchet for preventing inverse rotation of said ratchet wheel, said free lever being operated from the side of said body to produce disengagement of said ratchet from said ratchet wheel; and an adjusting means removably attached at the forward portion of said pistol-shaped body to adjust the length of insertion of said grooved needle into an article.

6. An apparatus for attaching a tag pin comprising:

a pistol-shaped body;

a lever supported on said body for rocking movement;

a rod driven by means of said lever;

a ratchet wheel mounted near a slot for inserting tag pins;

a ratchet for preventing the inverse rotation of said ratchet wheel and adaptable for disengagement therewith;

a feeding knob provided in an upper portion of said body, said knob having a feeding pawl element adapted for engagement with said ratchet wheel to drive said ratchet wheel;

a spring connected to said knob and engaged with a projection mounted on said body so as to permit forward movement of said knob while causing said spring to become biased, said biased spring capable of forcing return movement of said knob;

a grooved needle provided at one end of said pistol-shaped body, said rod being located for movement on the axis of said needle;

a piston supporting said rod;

a trigger-like lever means for directly driving said piston; and a free lever provided in relation to said ratchet for preventing inverse rotation of the ratchet wheel, said free lever being operated from the side of said body to produce disengagement of the ratchet from said ratchet wheel.

7. An apparatus according to claim 6 wherein said feeding knob has a first and a second projection extending downward from said knob, wherein said first projection supports said feeding pawl and engages said body portion, and said second projection supports said spring, and engages said body portion.

8. An apparatus according to claim 6, wherein said grooved needle is removably attached by means of a stopper in which a locking portion is provided at a part of a shaft portion thereof.

* * * * *